US010115378B1

(12) United States Patent
Jennings

(10) Patent No.: US 10,115,378 B1
(45) Date of Patent: Oct. 30, 2018

(54) LASER ETCHED STRINGED INSTRUMENT AND METHOD OF MANUFACTURE

(71) Applicant: Kurt Jennings, Soquel, CA (US)

(72) Inventor: Kurt Jennings, Soquel, CA (US)

( * ) Notice: Subject to any disclaimer, the term of this patent is extended or adjusted under 35 U.S.C. 154(b) by 1062 days.

(21) Appl. No.: 14/325,920

(22) Filed: Jul. 8, 2014

Related U.S. Application Data

(63) Continuation-in-part of application No. 13/764,321, filed on Feb. 11, 2013, now Pat. No. 8,772,616, which is a continuation-in-part of application No. 13/033,626, filed on Feb. 24, 2011, now abandoned.

(51) Int. Cl.
*G10D 1/00* (2006.01)
*G10D 3/06* (2006.01)

(52) U.S. Cl.
CPC ..... *G10D 1/005* (2013.01); *G10D 3/06* (2013.01)

(58) Field of Classification Search
CPC ..... G10D 1/005
See application file for complete search history.

(56) References Cited

U.S. PATENT DOCUMENTS 346,424 A 7/1886 Burton
357,168 A 2/1887 Barnwell
494,698 A 4/1893 Zorger
663,440 A * 12/1900 Isbell ..... G10D 1/06 84/268
D62,165 S * 4/1923 Gerl ..... 84/291
1,991,864 A 2/1935 Nopola et al.
2,511,552 A * 6/1950 Stuempges ..... B44F 1/08 264/112
3,396,621 A 8/1968 Dycus
3,403,590 A 10/1968 Quinton
3,410,979 A * 11/1968 Larsson ..... B23K 26/18 219/121.6
3,439,570 A 4/1969 Lee
3,550,496 A 12/1970 Fender
3,649,806 A * 3/1972 Konig ..... B23K 15/085 219/121.6
3,748,947 A 7/1973 Freiheit
3,845,686 A 11/1974 Salvo
3,910,151 A 10/1975 Copeland
3,978,756 A 9/1976 Feldman
4,031,801 A 6/1977 Cecchini
4,095,506 A 6/1978 Smith
(Continued)

*Primary Examiner* — Robert W Horn
(74) *Attorney, Agent, or Firm* — Allen D. Hertz, P.A.; Allen D. Hertz

(57) ABSTRACT

A method for creating the laser etched image in an instrument. The etching can be applied to bare wood, through a single layer of a contrasting coating, or through a plurality of layers to expose a layer having a contrasting color. The instrument can be prepared by applying one or more layers of coatings of different colors upon the surface. The programmed laser etches through a desired number of layers, exposing a target color, creating a multi-colored image. The etched material can be filled enhancing a contrast. The artwork can be aesthetic and/or functional, such as providing a series of note references laser etched into a fingerboard of the instrument. Each note reference is located respective to a position along a length of a respective string to generate the respective note and would be used for training a musician how to play the instrument.

18 Claims, 11 Drawing Sheets

(56) References Cited

U.S. PATENT DOCUMENTS 4,126,500 A * 11/1978 Palanos ..... B44C 1/02 156/154
4,139,409 A * 2/1979 Macken ..... B23K 26/0661 156/272.8
4,203,345 A 5/1980 Collins et al.
4,237,765 A 12/1980 Valdez
4,257,306 A 3/1981 Laflamme
4,286,495 A 9/1981 Roof
4,291,606 A 9/1981 Lepage
4,417,497 A 11/1983 Nicklaus
4,464,971 A 8/1984 Dean
4,629,858 A * 12/1986 Kyle ..... B23K 26/0853 219/121.69
4,712,464 A 12/1987 Nance
4,715,137 A * 12/1987 Scheve ..... G02B 6/0043 40/542
4,791,848 A 12/1988 Blum, Jr.
4,794,838 A 1/1989 Corrigau, III
4,807,509 A * 2/1989 Graham ..... G10D 3/06 84/314 R
4,915,005 A 4/1990 Shaffer et al.
4,939,970 A 7/1990 Hoshino et al.
4,951,542 A 8/1990 Chen
5,198,168 A * 3/1993 Thurston ..... B44C 1/26 264/129
5,347,904 A 9/1994 Lawrence
5,373,768 A 12/1994 Sciortino
5,383,385 A 1/1995 Gilbert
5,429,029 A 7/1995 Mendiola, Jr.
5,458,040 A 10/1995 Lawrence, Jr.
5,594,191 A 1/1997 Epstein et al.
5,660,668 A * 8/1997 Matheson ..... B23K 26/08 156/268
5,740,005 A 4/1998 Chen et al.
5,796,025 A * 8/1998 Haake ..... G10H 3/18 84/464 A
D410,671 S 6/1999 Aleksa
5,920,023 A 7/1999 Ravagni et al.
5,949,005 A 9/1999 Peterson
5,977,462 A 11/1999 Wolfson
5,990,444 A * 11/1999 Costin ..... B23K 26/03 219/121.61
6,034,310 A 3/2000 Kolano
6,051,766 A 4/2000 Taylor
6,191,348 B1 2/2001 Johnson
6,218,603 B1 4/2001 Coonce
6,231,196 B1 * 5/2001 Mahachek ..... G02B 5/08 359/15
6,452,061 B1 9/2002 Schmidt et al.
6,452,080 B1 9/2002 Coonce
6,452,081 B1 9/2002 Ravagni et al.
6,685,868 B2 * 2/2004 Costin ..... B41M 5/24 156/240
6,696,136 B2 * 2/2004 Baldwin ..... B44C 1/28 428/172
6,751,439 B2 6/2004 Tice et al.
6,781,049 B2 8/2004 Taylor
6,831,218 B2 12/2004 Steinberger
6,854,872 B2 * 2/2005 Davenport ..... B44F 1/06 362/565
6,984,780 B2 1/2006 Reierson
7,064,259 B1 6/2006 Kelly
7,081,575 B1 7/2006 Pieper et al.
7,084,340 B2 8/2006 Tan
7,355,110 B2 4/2008 Nash
7,381,878 B2 6/2008 Cook
7,408,105 B2 8/2008 Murdock
7,427,704 B2 9/2008 Huwaldt
7,427,707 B2 9/2008 Shaffer
7,465,870 B1 12/2008 Homan
7,470,455 B2 * 12/2008 Spurgeon ..... B41J 3/407 427/261
7,507,884 B2 * 3/2009 Carlson ..... B27M 1/003 84/192
7,518,048 B2 4/2009 Murray
7,635,809 B2 * 12/2009 Higgs ..... G10D 1/08 84/327
7,714,217 B2 * 5/2010 Nesbitt ..... B05D 3/007 84/173
7,732,687 B2 6/2010 Shaffer
7,736,706 B1 * 6/2010 Spurgeon ..... B41M 5/0088 427/258
7,767,894 B1 8/2010 Diakoulas
7,825,313 B2 11/2010 Shaffer
8,019,130 B2 * 9/2011 Aletto ..... G06K 9/00885 283/67
8,071,912 B2 * 12/2011 Costin, Sr. ..... B44C 1/005 219/121.85
8,138,404 B1 * 3/2012 Petros ..... G10D 1/005 84/267
8,192,040 B2 * 6/2012 Spurgeon ..... A63F 13/28 362/806
8,482,732 B2 * 7/2013 Dohse ..... G03F 7/70791 356/399
8,720,527 B1 * 5/2014 Shepherd ..... B22C 7/00 164/235
8,772,616 B1 * 7/2014 Jennings ..... G10D 3/06 84/293
9,504,165 B2 * 11/2016 Wang ..... H05K 3/146
2005/0172785 A1 * 8/2005 Fisher-Robbins ..... A63J 17/00 84/464 R
2006/0011576 A1 * 1/2006 Guynn ..... B44C 1/227 216/41
2006/0174748 A1 * 8/2006 Buhoveckey ..... G10D 3/06 84/314 R
2007/0163420 A1 * 7/2007 Reiss ..... G10D 1/085 84/329
2009/0019984 A1 * 1/2009 Ouellette ..... G10D 1/08 84/291
2009/0071314 A1 3/2009 Huwaldt
2009/0071941 A1 * 3/2009 Knoblauch ..... B23K 26/0838 216/94
2009/0266223 A1 10/2009 Tashima
2010/0122621 A1 5/2010 Newstetter
2011/0146477 A1 6/2011 Tsukamoto
2012/0111174 A1 * 5/2012 Portalet ..... G10D 3/06 84/293
2012/0285314 A1 * 11/2012 Kellner ..... G09B 15/026 84/485 R
2015/0298260 A1 * 10/2015 Morel ..... B41M 5/24 219/121.69
2016/0074865 A1 * 3/2016 Rao ..... B01L 3/5453 138/104
2016/0263620 A1 * 9/2016 Li ..... B23K 26/0087
2018/0160548 A1 * 6/2018 Stay ..... H05K 3/4069

* cited by examiner

LASER ETCHED STRINGED INSTRUMENT AND METHOD OF MANUFACTURE

CROSS-REFERENCE TO RELATED APPLICATION

This application is a US Non-Provisional Patent Application that is a Continuation-In-Part Patent claming the benefit of co-pending U.S. Non-Provisional patent application Ser. No. 13/764,321, filed on Feb. 11, 2013 (scheduled to issue as U.S. Pat. No. 8,772,616) that is a Continuation-In-Part Patent Application claiming the benefit of co-pending US Non-Provisional Patent Application that is a Continuation-In-Part Patent Application claiming the benefit of U.S. Non-Provisional patent application Ser. No. 13/033,626, filed on Feb. 24, 2011 (now abandoned), each of which are incorporated herein in their entireties.

FIELD OF THE INVENTION

The present invention relates to a stringed instrument enhanced by a laser etching process, wherein the laser etching provides artwork for improving an appearance of a body and/or neck including educational references for training and method of fabrication, and more particularly, a method of fabricating or modifying a stringed instrument to include a series of laser generated artwork and/or notes along a fingerboard to aid in teaching an individual how to the play the stringed instrument.

BACKGROUND OF THE INVENTION

One key element in learning how to play an instrument is learning a configuration to generate each respective specific note. Stringed instruments generate different notes by changing the effective vibrational length of the respective string. Each string spans between a location on a bridge, across a nut, and terminates at a respective tuning peg of an engaged tuning machine. The vibrating length of the string is altered by compressing the string against a fingerboard. Some stringed instruments include a series of frets located along the fingerboard in accordance with a scale. The string is compressed against the respective fret to generate the desired note. Other stringed instruments are fretless, where the musician would compress the string against the fingerboard. The location where the string contacts the fingerboard would define the generated note. The music student would need to become familiar with each location where the string would need to be compressed to generate each respective note as part of the learning process.

There are many prior art references to methods to teach instruments and, in particular, teaching devices for teaching an individual how to play string instruments, and more specifically a guitar. A representative example of this in the prior art is Aleksa, D410,671. The Aleksa device is a teaching method specifically for guitar players, wherein the teachings of Aleksa are limited to a design application that fails to include a method.

Another example in the prior art includes Kennedy, U.S. Pat. No. 5,746,605. The Kennedy device is a method to assist in music training in general, including electronic keyboards.

Another reference in the prior art is Ravagni U.S. Pat. No. 5,920,023. This reference is a stringed instrument finger positioning guide and method for teaching students to read music. In this application the fingers of the person playing the instrument are positioned by use of a series of markings both of the front of the neck as well as the side of the neck. Through shear repetition using the method that is taught in this application the beginner player will become more proficient and develop in essence what amounts to muscle memory. This is particularly important because each string has multiple notes depending of the position of the person's fingers on the fret board.

Another reference in the prior art is Sciortino, U.S. Pat. No. 5,373,768. This reference teaches a musical instrument neck illuminator using fiber optics. The current application does not use fiber optics nor is it limited to a neck illuminator. The current application teaches a method by which a person learns to play the guitar through the correct positioning of his or her fingers on the fret board.

Guitars are commonly designed having two primary components: (1) a body and (2) a neck. The neck can be permanently attached to the body or removably attached to the body.

Guitar bodies and necks have been finished using a variety of methods. One common method for finishing a guitar body and/or neck would be an application of paint. The paint can be clear, tinted, or opaque. The body is commonly fabricated of wood. The wood can be left untouched or can be stained to enhance a translucent or transparent finish. In another alternative finish, the wood can be oiled or waxed.

The finish can be enhanced by introducing artwork by airbrushing, hand painting, laminating decals, and the like. Paint can introduce unique finishes such as metal flake, pearl, thermochromic technology, paramagnetic technology, chroma-flair technology, and the like.

The outer surface of the bodies can be enhanced by adhering a secondary material, such as a mirrored material to an outer surface thereof, inlaying contrasting materials into the surface thereof, and the like.

Accordingly, there remains a need in the art for an easily adapting a stringed instrument to aid in training an individual how to play the instrument. Musicians strive for uniqueness. There is always an interest for new methods for adorning bodies and necks of stringed instruments. The instrument can be any stringed instrument including hollow body guitars, solid body guitars, hollow body bass guitars, solid body bass guitars, acoustic violins, electric violins, cellos, banjos. mandolins, and the like.

SUMMARY OF THE INVENTION

The present invention overcomes the deficiencies of the known art by disclosing a method of fabricated or modifying a fingerboard of a stringed instrument to include notes or note references to aid in teaching a music student how to play the stringed instrument.

In accordance with one embodiment of the present invention, the invention consists of a method of fabricating an educational, teaching for teaching a music student how to play a fretted, stringed instrument, the method comprising steps of:

obtaining a fingerboard for a fretted, stringed instrument;

assembling a series of frets to the fingerboard along a lateral direction across the fingerboard, each fret being located in accordance with a predetermined spacing;

creating a series of note identifiers by cutting a recession into the fingerboard using a laser, each note identifier is created proximate to a string and fret intersection and provided to identify a respective note defined by the adjacent string and fret intersection;

assembling the fingerboard to a neck of the fretted, stringed instrument; and assembling the fretted, stringed instrument neck and fingerboard combination to a fretted, stringed instrument body.

In one aspect, the series of recessions cut into the fingerboard are filled with a forming material, wherein the forming material hardens after being placed within the recess.

In another aspect, the method further comprises a step of applying a coating onto the fingerboard to preserve the integrity of the note identifiers. The coating preferably fills the recessions formed by the laser.

In another aspect, the method further comprises a step of assembling a series of positioning markers onto a playing surface of the fingerboard, wherein the each positioning marker would be located between a pair of adjacent frets.

In another aspect, the method further comprises a step of assembling a series of side positioning markers onto a side surface of the fingerboard, wherein the each side positioning marker would be located between a pair of adjacent frets.

In another aspect, the method further comprises a step of creating a series of nut note identifiers by cutting a recession into the fingerboard using a laser, each nut note identifier is created proximate to a string and nut intersection, wherein each nut note identifier is representative of a respective note defined by the adjacent string and nut intersection.

In another aspect, the note identifiers are generated in a shape representative of a series of whole notes.

In another aspect, the note identifiers are generated in a shape of English alphabetical representations of a series of whole notes.

In another aspect, the note identifiers can be filled with filler of different colors to of different colors to further aid in identifying and distinguishing between different notes. All of the like notes would be filled with like colored filler, wherein each note would be defined by a different color.

In accordance with a second embodiment of the present invention, the invention consists of a method of fabricating an educational, teaching for teaching a music student how to play a stringed instrument, the method comprising steps of:

obtaining a fingerboard for a stringed instrument;

determining a series of locations along each string location along a longitudinal length of the fingerboard where a music student would compress a respective string against the fingerboard to generate specific notes;

creating a series of note identifiers at each determined specific note location along the fingerboard under each string location by cutting a recession into the fingerboard using a laser, each note identifier teaches the music student a location to compress each respective string to generate a specific note;

assembling the fingerboard to a neck of the stringed instrument; and assembling the fretted, stringed instrument neck and fingerboard combination to a stringed instrument body.

In yet another aspect, the laser generation of the series of note references is created upon a fingerboard prior to assembly to a neck of a stringed instrument body.

In yet another aspect, the laser generation of the series of note references is created upon a fingerboard after assembly to a neck of a stringed instrument body.

In yet another aspect, the laser generation of the series of note references is created upon a fingerboard after a neck is assembled to a stringed instrument body.

In yet another aspect, the laser etching process can be adapted to enhance aesthetics of the body and/or neck of the stringed instrument.

In yet another aspect, the laser etching process can be programmed to etch through a single layer of a coating. The coating can be an opaque material, a tinted translucent material, a translucent material, and the like.

In yet another aspect, the laser etching process can be programmed to etch through a single layer of a coating, exposing a secondary layer applied beneath the etched outer layer.

In yet another aspect, the laser etching process can be programmed to etch through any quantity of multiple layers of a coating, exposing a predetermined layer beneath the etched layers. Each layer of the multiple layers of coating would be of differing/contrasting colors. The laser would remove a predetermine number of layers in a preprogrammed pattern to expose a specific colored layer. This provides the artist with an ability to provide multicolored laser etched artwork having different exposed colors.

In yet another aspect, the etched surface can be coated with a clear topcoat to protect the etched artwork.

In yet another aspect, a contrast filler can be laid into the etched surface to enhance a contrast between the etched artwork and the adjacent exposed surface.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
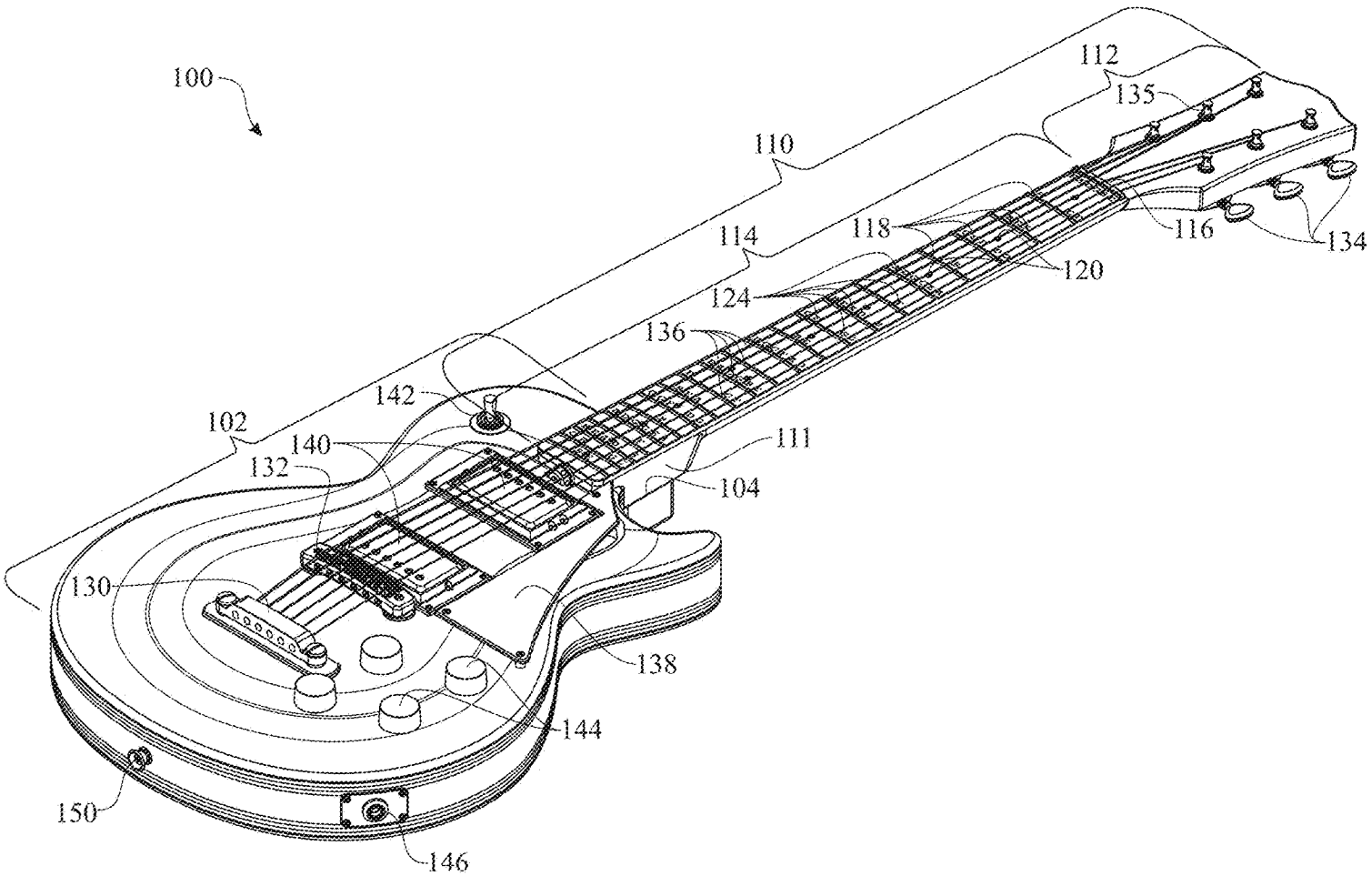
FIG. 1 presents an isometric view of an exemplary training guitar, wherein the illustration introduces the primary components of the training guitar.
Figure 2:
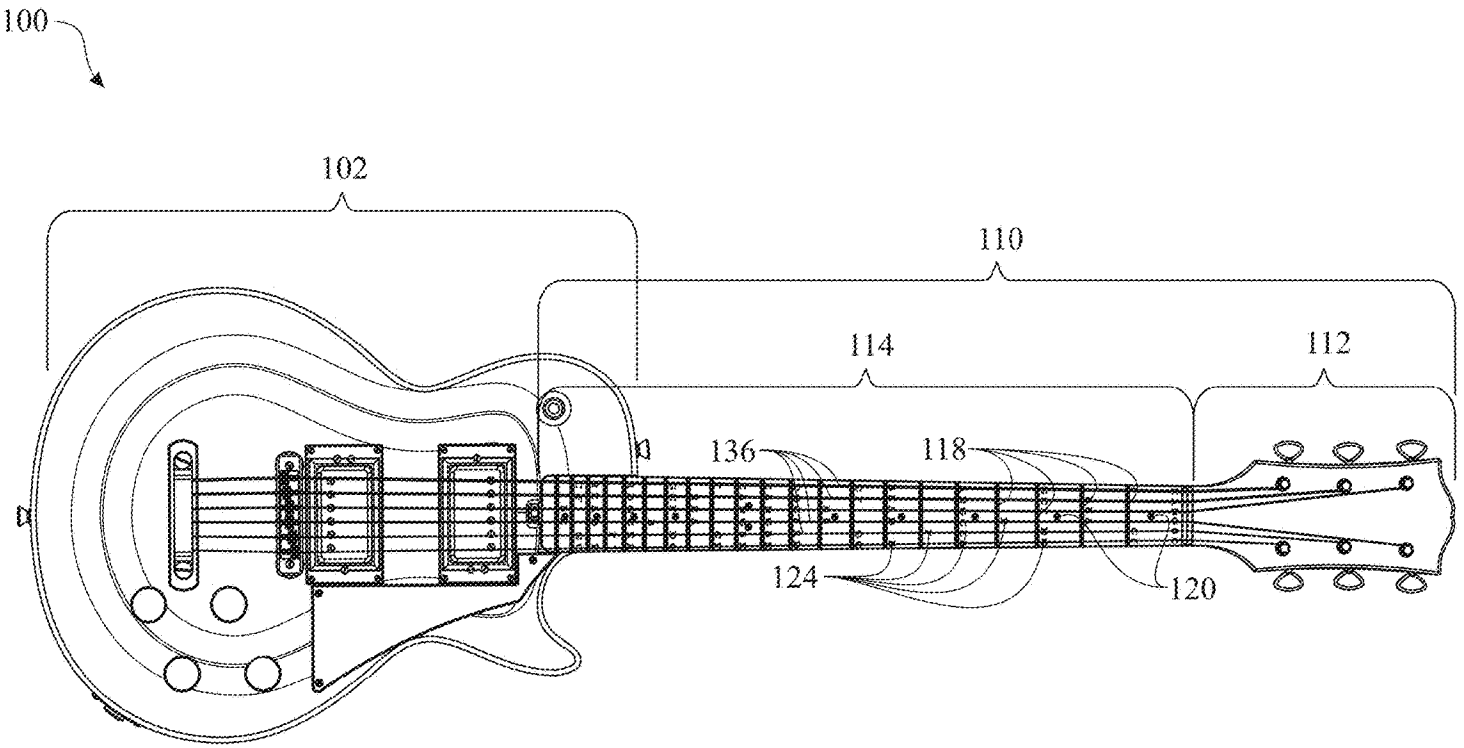
FIG. 2 presents a top view of the exemplary guitar originally introduced in FIG. 1.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Stringed instruments can include guitars, bass guitars, violins, cellos, banjos, mandolins, and the like. Stringed instruments comprise a majority of like elements. A training guitar 100 is presented in FIGS. 1 through 6, wherein the training guitar 100 is representative of any stringed instrument. It is understood that the stringed instrument 100 can be any stringed instrument including a hollow body guitar, a solid body guitar, a hollow body bass guitar, a solid body bass guitar, an acoustic violin, an electric violin, a cello, a banjo, a mandolin, and the like.

Figure 5:
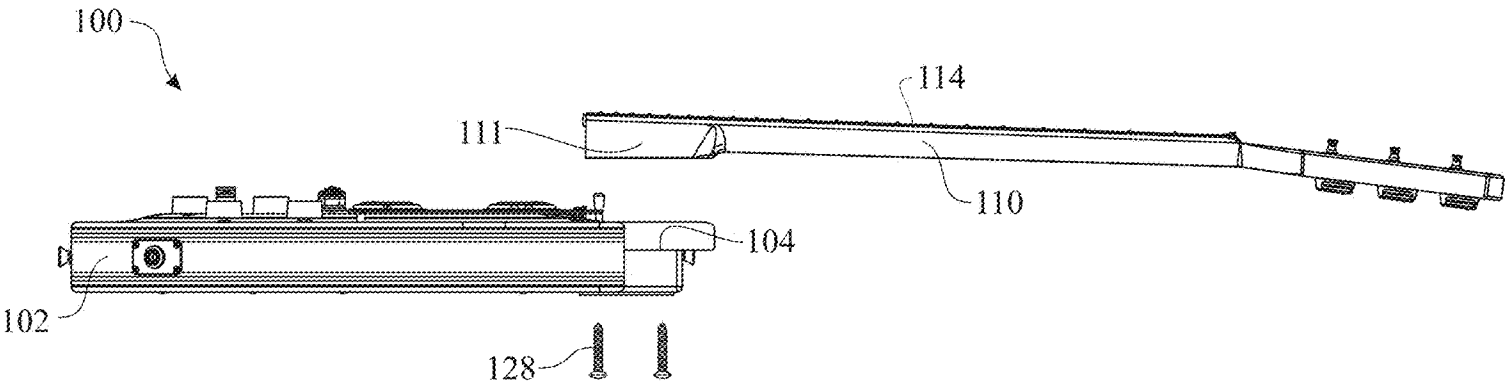
FIG. 5 presents a partially exploded assembly side view of the exemplary guitar originally introduced in FIG. 1.
Figure 6:
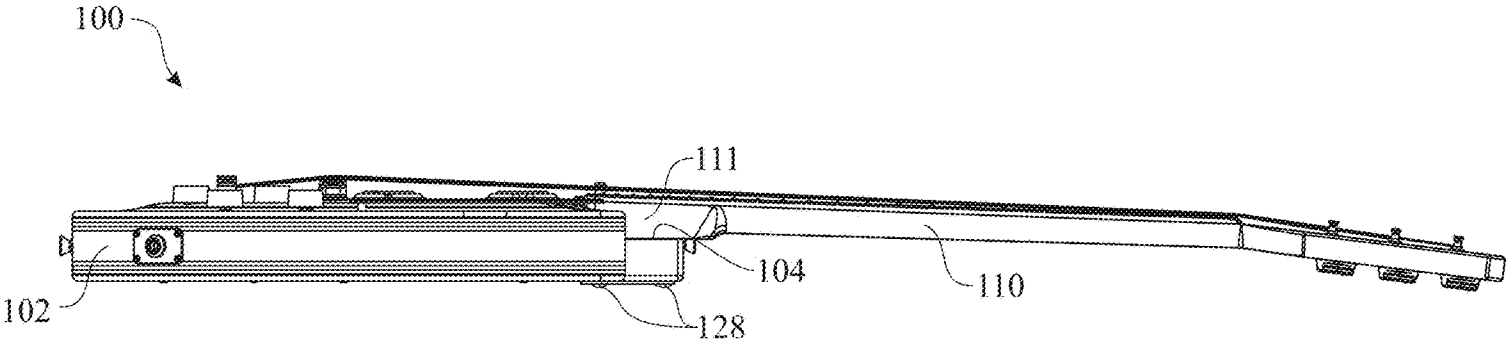
FIG. 6 presents an assembled side view of the exemplary guitar originally introduced in FIG. 1.

Each stringed instrument comprises two primary members: a guitar body 102 and guitar neck 110. Details of the guitar body 102 and guitar neck 110 will be provided below. The guitar neck 110 can be attached to the guitar body 102 using any of a variety of configurations. In one configuration, the guitar neck 110 is integrated into the guitar body 102; commonly referred to as a neck through body configuration. In a second configuration, the guitar neck 110 can be attached to the guitar body 102 using any bonding agent known by those skilled in the art, including a one part epoxy, a two part epoxy, a resin based adhesive, a hide based adhesive, and the like. In a third configuration, the guitar neck 110 can be removably attached to the guitar body 102 by a mechanical fastener. In the exemplary embodiment, the guitar neck 110 is removably attached to the guitar body 102 by a series of neck attachment screws 128 as illustrated in FIGS. 5 and 6. A neck mount section 111 is formed at a base region of the guitar neck 110. A mating neck receptacle 104 is formed within a respective region of the guitar body 102, wherein the neck mount section 111 preferably snugly engages with the neck receptacle 104. Each neck attachment screw 128 is inserted passing through a hole drilled through the guitar body 102 from a rear and threadably engaging with the neck mount section 111. The joint can be reinforced by including a neck support plate (illustrated but not identified) between a head of the neck attachment screws 128 and the back surface of the guitar body 102.

The guitar body 102 can be designed and fabricated in accordance with any of a variety of form factors. The guitar body 102 can be fabricated of a single piece of material, a series of laminated pieces of material, a series of laminated pieces of two or more materials, formed by including one or more bent sheets of material, using one or more carved pieces of material, and the like. The guitar body 102 can be designed to be hollow, semi-hollow, or solid. The shape of the guitar body 102 is determined by the designer. The guitar body 102 is commonly fabricated of a wood. In alternative embodiments, the guitar body 102 can be fabricated of other materials, including a molded plastic, a molded composite, any of a variety of metals, and the like.

The guitar neck 110 is commonly segmented into a headstock 112 and a fingerboard 114. It is noted that the fingerboard 114 can alternatively be referred to as a fretboard 114. The headstock 112 is designed to support a compliment of tuning machines 134. Each tuning machine 134 includes and rotates a tuning peg 135. The shape, size, and angle of the headstock 112 can vary based upon the designer's choice. Each tuning peg 135 is located on the headstock 112 to avoid or at least minimize interference with any of the strings 136. The fingerboard 114 is either shaped upon a playing surface of the guitar neck 110 or fabricated of a separate component and subsequently bonded to an upper surface of the neck 110.

The exemplary embodiment presents a fretted version of the stringed instrument. A fretted instrument refers to an instrument having a series of frets assembled to the fingerboard 114.

Figure 3:
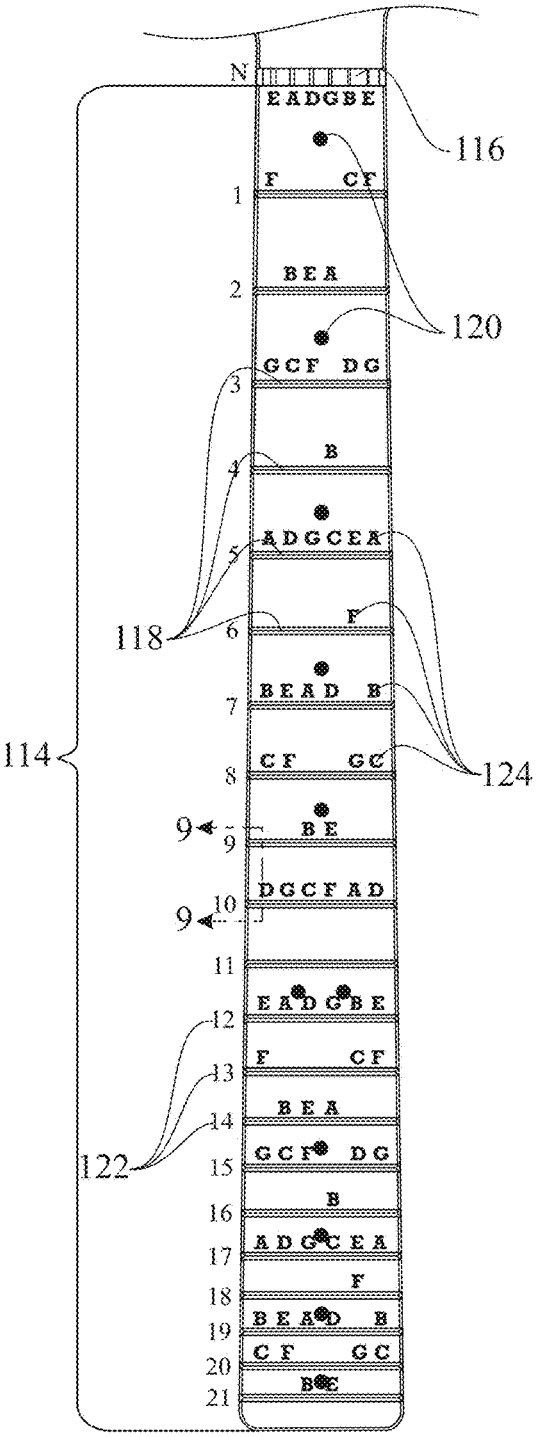
FIG. 3 presents a top view of a fingerboard of the exemplary guitar originally introduced in FIG. 1.
Figure 4:
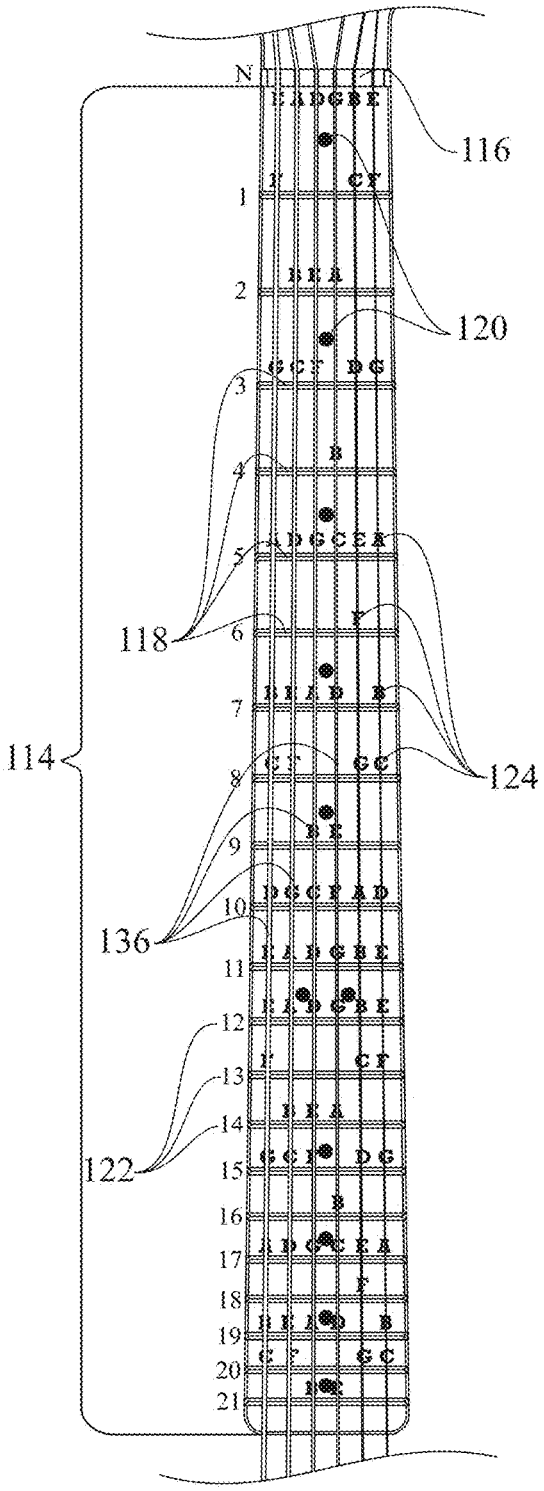
FIG. 4 presents a top view of a fingerboard of the exemplary guitar originally introduced in FIG. 1, the illustration further includes a set of strings to present a locational relationship between the note references, each respective fret, and each respective string.

A fret 118 is a raised element on the neck 110 of the stringed instrument 100. Frets 118 usually extend across the full width of the neck 110. On most modern fretted instruments, frets are metal strips inserted into the fingerboard 114. Frets 118 divide the neck 110 into fixed segments at intervals related to a musical framework. On instruments such as guitars, each fret represents one semitone in the standard western system where one octave is divided into twelve semitones. The frets 118 are referred to by a fret number 122, as illustrated in FIGS. 3 and 4.

The musician applies a compression force to one or more strings 136, pressing the string 136 against a respective fret 118. When the string is vibrated, the string 136 emits a sound at a specific frequency, wherein the specific frequency is referred to as a note. The musician must know which string and which fret combination must be used to generate each specific note.

A fret marker 120 can be included between certain frets 118 to help the musician identify a number of each respective fret 118. It is common to include fret markers 120 to identify the $3^{rd}$, $5^{th}$, $7^{th}$, $9^{th}$, $12^{th}$, $15^{th}$, $17^{th}$, $19^{th}$, $21^{st}$, and $24^{th}$ frets. The exemplary embodiment also includes a fret marker 120 to identify the $1^{st}$ fret 118. The fret markers 120 can be provided in any of a variety of form factors and materials. The industry standard is a circular piece of mother of pearl, referred to as an inlay. The circular inlay is placed into a round hole drilled into the fingerboard 114 using a flat-bottomed drill bit. Although the common material is mother of pearl, it is known by those skilled in the art have been known to use a wide variety of planar sheets of material for the inlay. The inlays can be fabricated of any suitable shape and size, from simple circular designs to elaborate designs spanning the entire fingerboard 114. In additional to a series of fret markers 120, a respective fret side marker 170 (FIG. 9) can be placed on a visible edge of the fingerboard 114.

Figure 9:
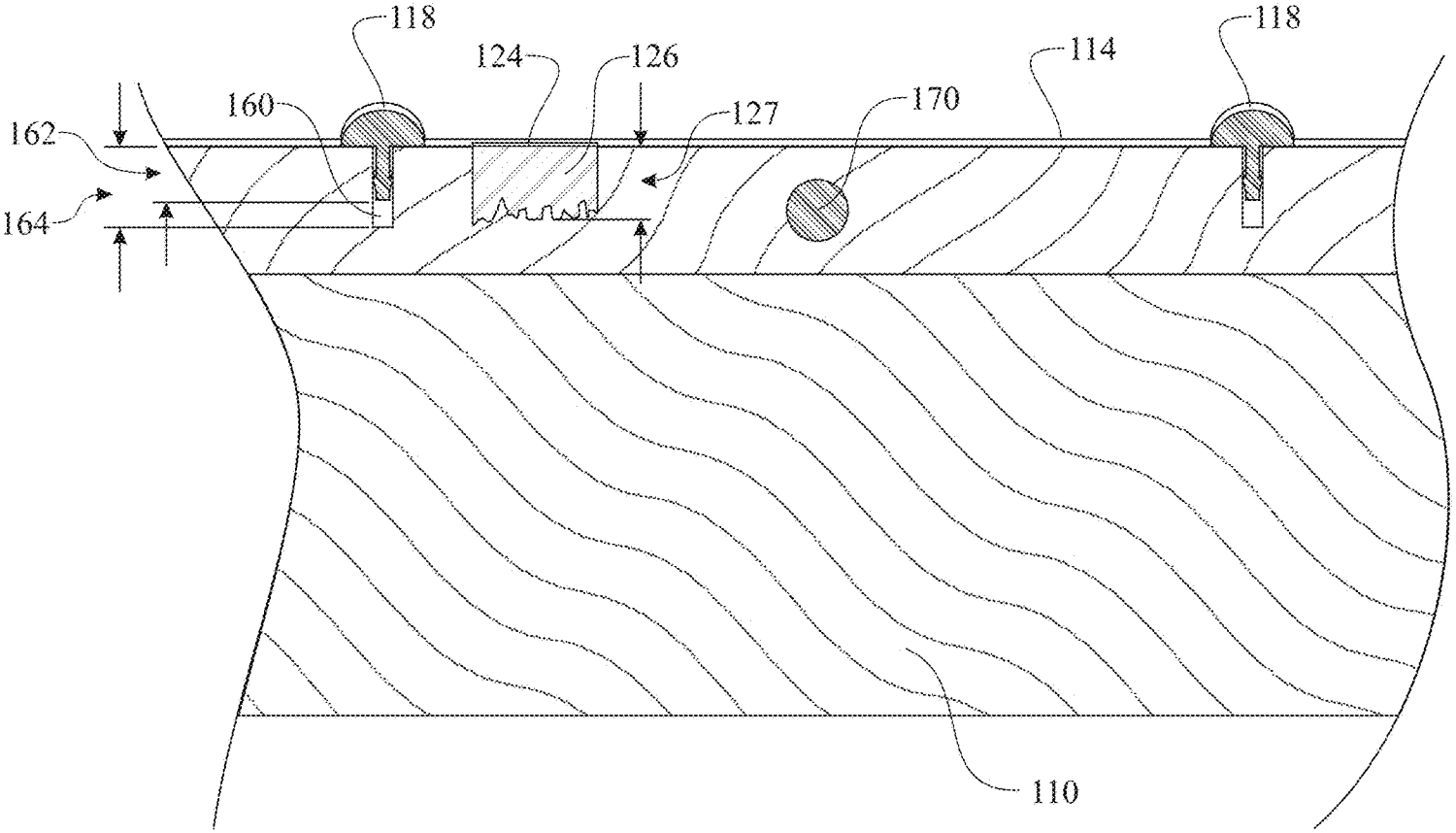
FIG. 9 presents a sectioned side view of the fingerboard illustrating a recess of the laser generated note reference.

In the fretted version of the training guitar 100, a series of fret slots 160 are cut into the fingerboard 114 for receiving a tang of a fret 118 as detailed in a sectioned view presented in FIG. 9. Each fret slot 160 is cut into the fingerboard 114 to a depth described as a fret slot depth 164. The fret slot depth 164 must be greater than a fret depth 162 of each respective fret 118 to ensure a fret 118 properly seats upon the upper surface of the fingerboard 114. Each fret slot 160 is located at a distance from the nut 116 calculated based upon a predetermined scale. Each instrument has one or more standard scales. The scale is used to calculate a span between adjacent apexes of the frets 118 and a bridge 132. Each fret slot 160 is oriented at a right angle (transverse) to a longitudinal length of the fingerboard 114 and cut into the fingerboard 114 to a predetermined minimum fret slot depth 164. The tang of the fret 118 is inserted into the fret slot 160. The fret 118 is retained in position by a series of barbs spatially formed along the tang of the fret 118.

The stringed instrument includes a series of strings 136 spanning along a longitudinal length of the fingerboard 114. Each string 136 is placed under a tension. Each string vibrates at a natural frequency based upon the following equation:

$$f=(\tfrac{1}{2}L)*\sqrt{(T/\mu)}$$

where f is the frequency in hertz (Hz) or cycles per second

T is the string tension in gm-cm/$s^2$

L is the length of the string in centimeters (cm)

μ is the linear density or mass per unit length of the string in gm/cm $\sqrt{(T/\mu)}$ is the square root of T divided by μ in seconds A bridge end of each string 136 is commonly retained by a tailstock 130. The tailstock 130 can be provided in any of a variety of form factors. The tailstock 130 can be an independent component, integrated into a bridge 132, formed through the guitar body 102, and the like. A nut end of each string 136 is commonly retained by a tuning peg 135 of a respective tuning machine 134. The tuning machine 134 rotates the tuning peg 135 to roll up and collect a portion of the string 136, thus adjusting a tension applied to the string 136. The string is routed from the tailstock 130, eclipsing over a triangular shaped edge formed upon an upper surface of the bridge 132, continuing to a nut 116, and terminating at the tuning peg 135.

The maximum vibrational length of the string 136 is defined by the span between the bridge 132 and the nut 116. The vibrational length can be reduced by applying a pressure to any of the strings 136 to compress the string 136 against a respective fret 118. The fret 118 redefines the vibrational length of the string 136, thus changing the vibrational frequency or note of the string 136.

Each of the strings 136 is fabricated having a different density to change the notes respective to the arrangement of the instrument.

The exemplary training guitar 100 includes electronics to provide an electrical signal output for amplification of the generated music. The vibrations of the strings 136 are converted into an electrical signal by one or more pickups 140. The sound can be manipulated by any of a variety of electrical components or electronic assemblies. A pickup selector switch 142 can be integrated into the circuit to modify a wiring configuration of the one or more pickups 140. The pickup selector switch 142 can be used to split wiring within one pickup 140, modify a wiring configuration between two or more pickups 140, and the like. The training guitar 100 can include one or more pickup selector switches 142, depending on the variety of options desired by the instrument owner. A series of volume and tone controls 144 can be integrated into the circuit, enabling adjustments to the output volume and/or tone of the electrically generated sound. The electrically generated sound signal is transferred from the training guitar 100 to another electrically operated device by an output jack connector 146. The electrically operated device can amplify the signal and transfer the signal to a speaker; manipulate the electrically generated sound signal to modify the signal (commonly accomplished by an effects device), changing the resulting sound; recording the output sound, and the like.

The training guitar 100 can include additional accessories, including a pickguard 138 for protecting the finish of the guitar body 102 from scratches during use and a strap fastener 150 for attachment of a shoulder strap. The size, shape, and location of the pickguard 138 and strap fastener 150 can vary.

The training guitar 100 can be manufactured or modified to include a series of note references 124. Each note reference 124 is created by laser engraving the fingerboard 114. Exemplary processes for creating the series of note references 124 are presented in FIGS. 7 through 9. The series of note references 124 is formed by using a laser wood removal system 200 to remove material from the fingerboard 114.

The exemplary embodiment presents a training guitar 100 having a typical whole tone scale. A beginner guitar player will typically learn on the whole tone scale. This scale is comprised of a given set of notes corresponding to a set of strings, which are tuned or tightened to produce the following sounds from top string to bottom string: E, A, D, G, B and E. For purposes of this application the whole tone scale will be used. In stringing most guitars, the top string 136 is the thickest or heaviest string 136 and the bottom string 136 is the thinnest or lightest string 136.

On the whole note scale the strings 136 from top to bottom play the following notes when played "open" i.e. without depressing the string: E, A, D, G, B, E. For purposes of this illustration it is assumed that the strings have been properly tightened or tuned to produce the specific note sound or quality. For instance, if the person plucked the top string 136 without depressing the string 136 against any of the frets 118, the sound produced would be an "E" and if the second string 136 was plucked the sound produced would be an "A" and so on.

The musician would depress a respective string 136 against a desired fret 118 to change the output note of the respective string 136. If the person wanted to produce an "E" note while pressing on the fret length the person could press the third string above the second fret. Likewise if a person wanted to produce an "F" the person could press the top or the bottom string above the first fret. This device trains the individual where to position his or her fingers in order to produce the desired tonic sound.

A laser wood removal system 200 is used to modify the fingerboard 114 as desired. The laser wood removal system 200 includes a laser programming station 210, which programs a laser controller 220, wherein the laser controller 220 operates a laser 230 to remove the desired material from the fingerboard 114 forming each of the note references 124 of the series of note references 124. Each note reference 124 is formed by laser engraving a recession within the fingerboard 114 to a note reference depth 127. The laser programming station 210 can be any computing device, preferably including a computer 212, a monitor 214 and a user computer input appliance 216. The user would generate a series of instructions that are passed to the laser controller 220 for directing the operation of the laser 230. The object is placed upon a table. The laser 230 is moved in accordance with a coordinate system to change the longitudinal 224 and lateral 222 positions thereof. Although the exemplary embodiment moves the laser 230, it is understood that the supporting platform (not shown) can move the object, where the laser 230 would remain stationary. The exemplary coordinate system can additionally include a vertical component to adjust the focal point of the laser beam 232. Alternatively, the laser 230 can include a focal adjustment to change the focal length of the beam. The laser 230 emits a laser beam 232, directing a focal point onto a surface of the fingerboard 114. The laser beam 232 removes material from the fingerboard 114 forming the images of the note references 124. The distance of travel of the coordinate system is preferably sufficient to span an entire width and length of the fingerboard 114. Should the distance of travel of the laser control system be smaller that the entire width and length of the fingerboard 114, the user would reposition the object to accommodate the travel limitations of the system.

The operator would create a program to generate the series of note references 124. The program would utilize exemplary entry data 219, including dimensional information of the neck 110, including a length of the fingerboard 114, a width of the fingerboard 114 at the bridge end, a width of the fingerboard 114 at the nut end, a distance between strings 136, a number of installed frets 118, a scale or spacing between frets 118, the material of the fingerboard 114, the desired style of marking for the note references 124, a desired depth of each note reference 124, and the like. The desired depth of each note reference 124 can be between just a fraction of a millimeter or up to 6.5 millimeters (¼ of an inch). The note references 124 can be designed in any image, wherein a preferable image is an alphabetical representation of each whole note as best illustrated in FIG. 3. The designer can select a font from any available font. Each note reference 124 would be located proximate an intersection between a respective note defining point and the respective string 136, as best illustrated in FIG. 4. The first series of note references 124 would be placed proximate the nut 116. The remaining note references 124 would be located proximate the respective fret 118.

The laser engraving process is affected by the density of the material of the fingerboard 114. Fingerboards 114 are commonly fabricated of a wood, such as rosewood, ebony, maple, and the like. The grain of the woods causes differences in the depth of the cut generated by the laser as illustrated in FIG. 9. The note references 124 can be finished in a several ways as a result of the variations in the cut depth and the narrow lines required to form the note references 124. The recessions can be left as formed to present a less noticeable appearance. The recessions can be filled with a formable note reference filler 126 and subsequently cured, wherein the note reference filler 126 is colored to contrast the fingerboard 114, thus presenting a more distinguished and noticeable appearance. The note reference filler 126 can be an epoxy, paint, a resin, a heated metal, and the like. Once cured, the upper surface can be leveled with the upper surface of the fingerboard 114. The note reference filler 126 can be of different colors to further aid in identifying and distinguishing between different notes.

Figure 7:
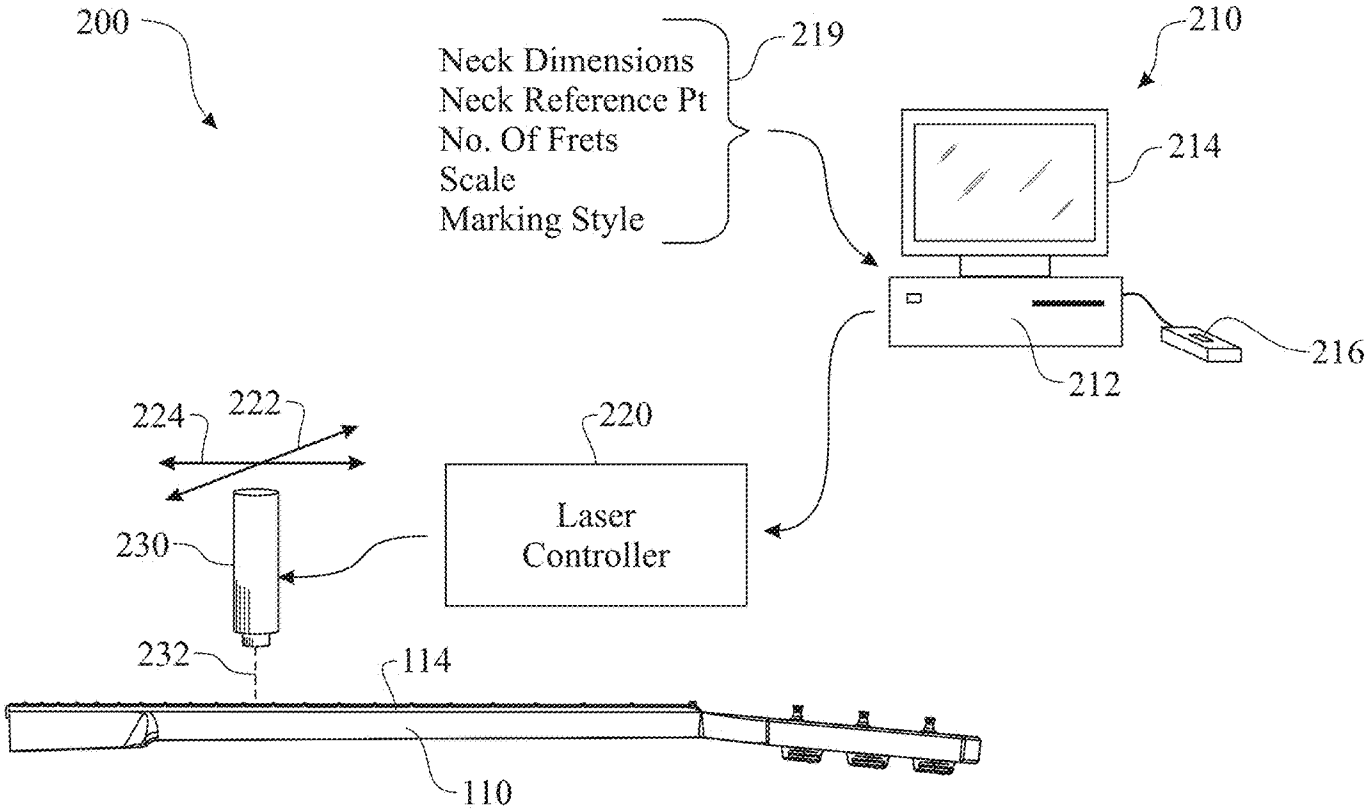
FIG. 7 presents a first exemplary block diagram representative of a laser note reference forming process, wherein the process is accomplished when the neck is separated from the stringed instrument body.
Figure 8:
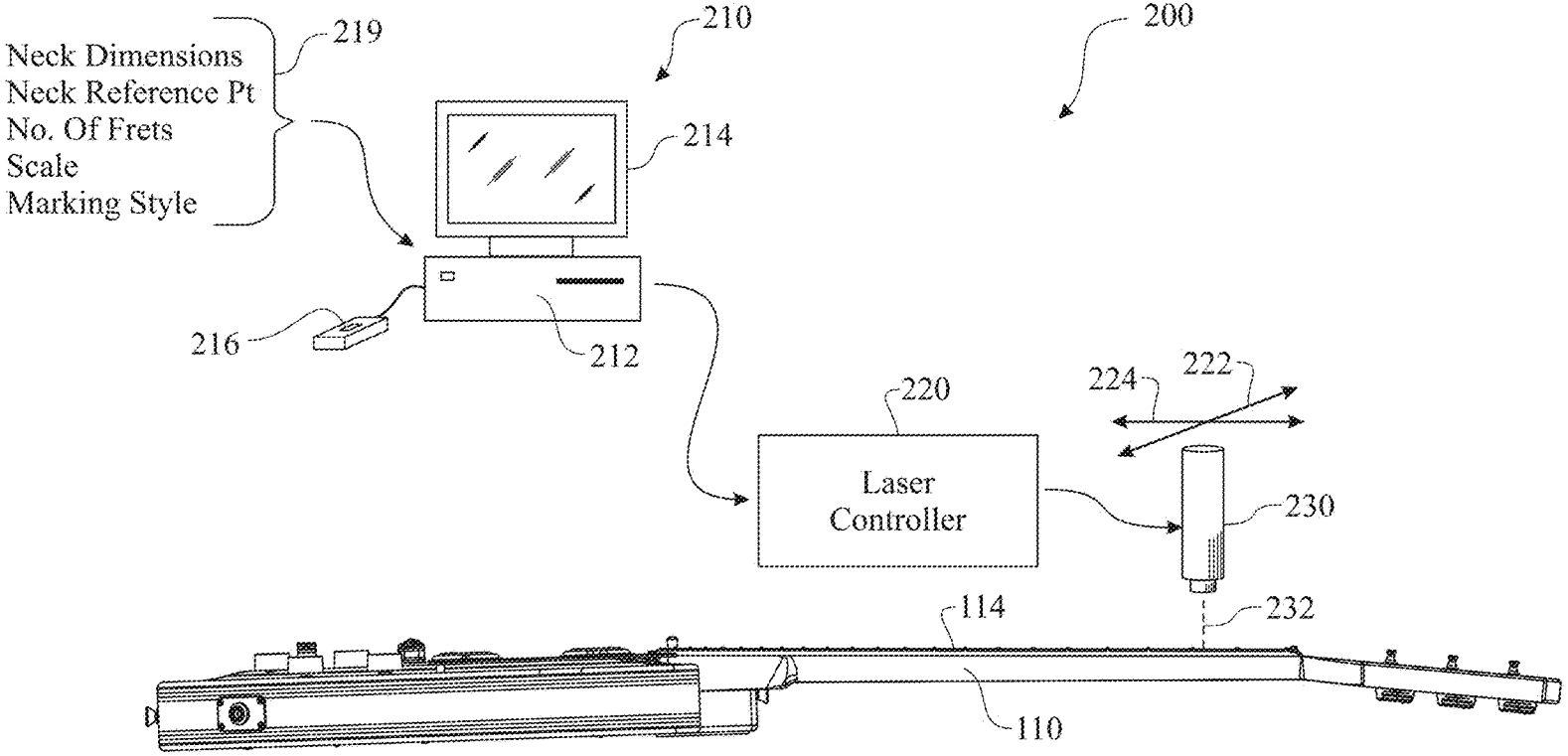
FIG. 8 presents a second exemplary block diagram representative of a laser note reference forming process, wherein the process is accomplished upon a finished stringed instrument.

In use, the process can be adapted to either neck assembly configuration of the training guitar 100. In a configuration where the guitar neck 110 is removably attached to the guitar body 102, the guitar neck 110 is removed and placed upon a support of the laser wood removal system 200 as illustrated in FIG. 7. After processing, the guitar neck 110 is reattached to the guitar body 102. In a configuration where the guitar neck 110 is permanently attached to the guitar body 102, the training guitar 100 is placed upon a support of the laser wood removal system 200 as illustrated in FIG. 7.

The training guitar 100 is intended to quickly train the beginner musician to position his or her fingers on the appropriate fret 118 by imprinting the notes 124 into the fingerboard 114 of the guitar neck 110. Because the notes change along the neck and because different notes can be played depending on the positioning of the fingers along the neck 110 of the guitar 100, all the notes for a particular scale are imprinted along the neck 110 of the guitar 100 and the neck 110 can be easily removed, if needed. In this manner if the person wanted to learn a particular scale, the person would secure the appropriate neck with the proper indicators and practice using that neck. Through repetition the person would develop muscle memory and in this manner would quickly learn the scale by visual reference to the markers 170 of the side of the neck 110 of the guitar 100.

The method to imprint the notes should not alter the sound of the note or the quality of the sound. The electronic system can enhance the education process, wherein the signal output can be connected to a computing device to provide feedback to the student. The computing device can include software to record the music generated by the training guitar 100, analyze the generated music against a reference to determine if the musician is playing the song correctly, and the like. The system can also be used to aid in training the student how to play scales, cords, and the like.

Figure 10:
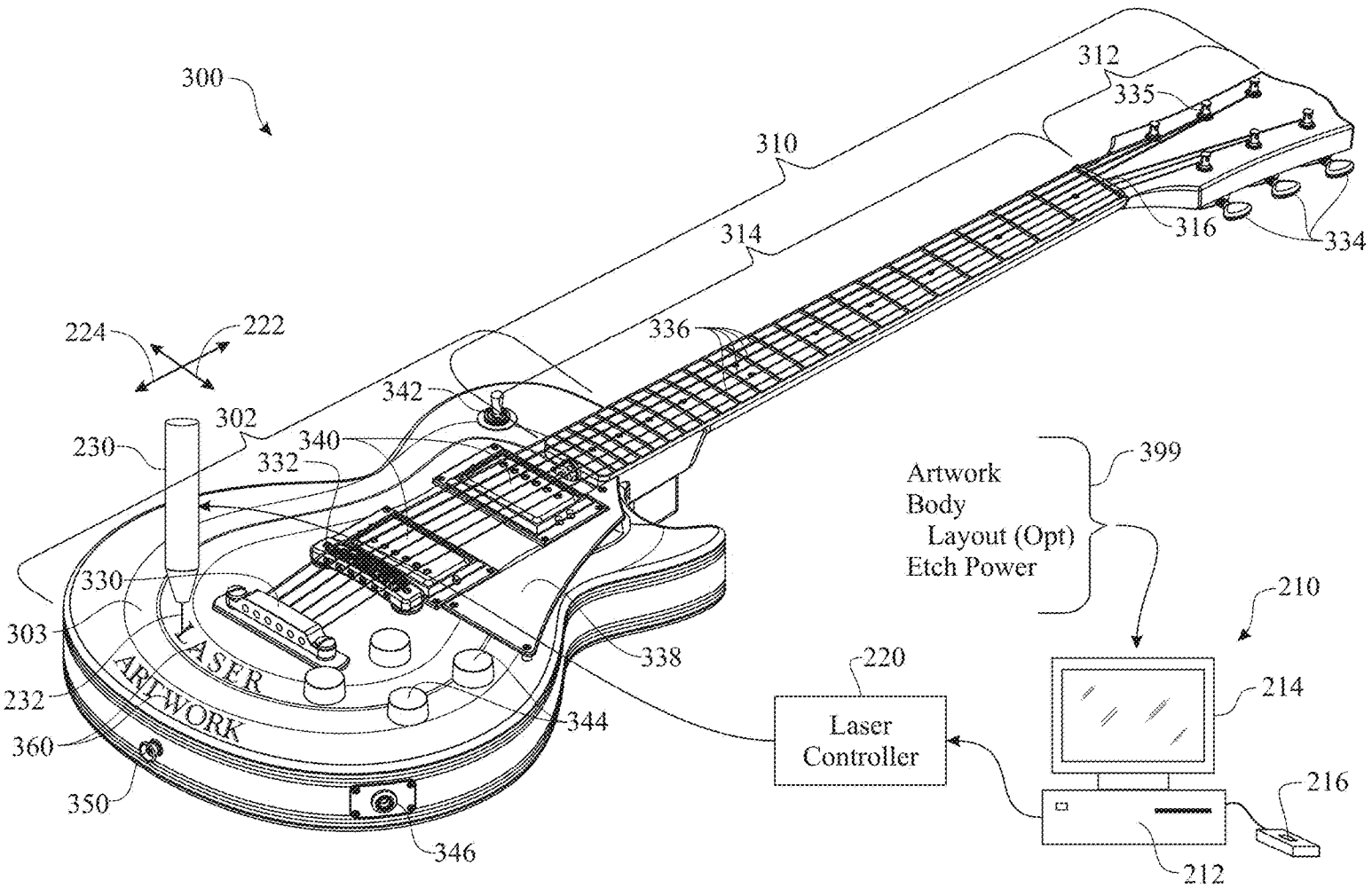
FIG. 10 presents an isometric view of a solid body electric guitar having an exemplary laser generated artwork etched into the body.

The laser etching can be applied to create aesthetic improvements on a guitar body 302 and/or a guitar neck 310 of a laser etched guitar 300, as presented in an exemplary embodiment illustrated in FIG. 10. It is understood that the stringed instrument 300 can be any stringed instrument including a hollow body guitar, a solid body guitar, a hollow body bass guitar, a solid body bass guitar, an acoustic violin, an electric violin, a cello, a banjo, a mandolin, and the like.

The laser etched guitar 300 comprises a number of similar elements to those of the training guitar 100 previously described, wherein like elements of the laser etched guitar 300 and the training guitar 100 are numbered the same except preceded by the numeral '3' with an introduction of a laser etching 390. A laser system, as previously described, is programmed with a laser artwork etching program data 399. The laser artwork etching program data 399 can include data such as artwork for etching, an artwork routing path, a body layout, laser etching power, and the like. The artwork can be any suitable artwork, including images, graphics, lettering (in any language), numbering, characters, symbols, and the like, and any combination thereof. The artwork routing path would define the path for the laser etching process. This can consider heat, heat dissipation, speed, density, visual inspection during etching, angular rotation of the laser 230, and the like. The body layout can include a body profile defining a peripheral edge and any features, such as cutouts for pickups 340; a location of a pick-guard 338; locations of electronic controls 342, 344; a location of a bridge 332, a location of a tailpiece 330, and any other feature. The body layout can additionally include a topographical profile to enable the laser to adapt to the height of a non-planar guitar body top surface 303. The laser etching power would provide details that would be aid in properly configuring the laser for etching through the specific coating covering the guitar body top surface 303 of the laser etched guitar 300. This can include a predetermined laser etching power, a composition of the coating, a thickness of the coating, and the like. A camera, a height sensor, and the like can be adapted to the laser 230 to aid in following a contour of the guitar body top surface 303. The camera can additionally or alternatively be used to determine if the laser etching power is properly set for etching through a specific layer or plurality of layers as programmed and desired.

Figure 11:
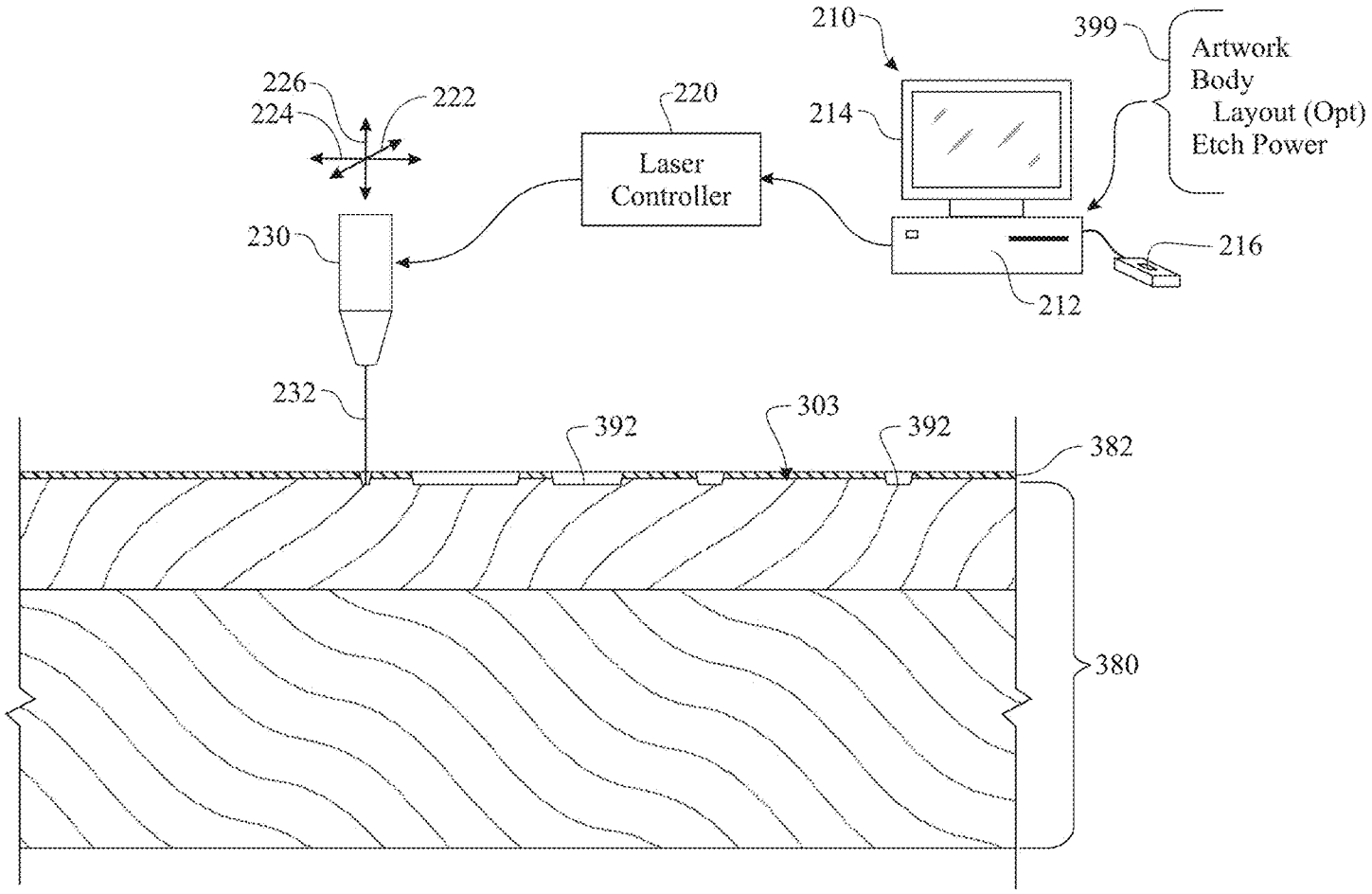
FIG. 11 presents an exemplary cross sectional view of the solid guitar body having a single composition coating layer applied to an exterior surface, having a laser generated artwork etched through the single composition coating layer exposing a contrasting surface therebeneath, creating an artwork image from contrasting colors.

A single layer etching process is presented in a cross sectional view illustrated in FIG. 11. A guitar body coating first layer 382 is applied upon the guitar body top surface 303 of the laser etched guitar 300 (more specifically the guitar body top surface 303 of the guitar body material 380 as illustrated in FIG. 11). A laser system is programmed with the laser artwork etching program data 399. The laser artwork etching program data 399 includes instructions for directing the laser 230 along a path through a special environment, including movements along a laser lateral movement 222, a laser longitudinal movement 224, and a laser vertical movement 226. The laser artwork etching program data 399 additionally provides instructions for activating and deactivating the laser 230 for emitting the laser beam 232 as desired.

The laser etched guitar 300 and the laser 230 would be located in registration with one another. The laser system can include a feature enabling a projection of the laser image upon the guitar body top surface 303 to determine a proposed final artwork location, to ensure that the laser and the target section of the stringed instrument are in proper alignment prior to initiating said etching step. The artwork can be projected using any known image projection method. The artwork projection would be calibrated to replicate the dimensions of the final artwork. The laser would be programmed to reference the desired location of the artwork image upon the etched guitar body top surface 303. When active, the laser beam 232 removes a portion of material from the guitar body coating first layer 382 in a finite defined area. If the laser 230 is moving, the laser beam 232 would remove a portion of material from the guitar body coating first layer 382, forming a first laser etched depth 392, in a continuous flow. The continuous flow can be along a linear path, a curved path, forming a corner, and the like by translating the laser 230 in accordance with the laser lateral movement 222 and laser longitudinal movement 224 individually or in combination thereof. A width of the first laser etched depth 392 (as shown in the illustration presented in FIG. 11 with a plurality of first laser etched depths 392 having different widths) can be adjusted by modifying the laser etching properties, providing a circular motion of the laser beam 232, such as by wobbling the laser 230, passing the laser beam 232 along parallel paths of one another, and positioned slightly offset from each previous pass, and the like. The etching process would etch trough the guitar body coating first layer 382, exposing the guitar body material 380 therebeneath. This would present a contrast between the guitar body material 380 and the guitar body coating first layer 382. The contrast presents an image of the etched artwork. Additionally, the laser beam 232 can be of a sufficient power to burn or discolor the guitar body material 380, enhancing the contrast between the guitar body material 380 and the guitar body coating first layer 382. Once the etching process is complete, the etched surface can be protected by applying a clear coat over the surface. Alternatively, a contrasting filler can be applied to the surface, filling the first laser etched depths 392, creating a contrast between the filler material and the exposed surface of the guitar body coating first layer 382.

When creating an etched artwork image 390 onto a guitar body top surface 303 that has a topography profile or contoured surface, the programming can include a model of the associated topography profile. The process would accommodate the topography profile by either providing a laser vertical movement 226 and/or adjusting a focal position of the laser beam 232.

Figure 12:
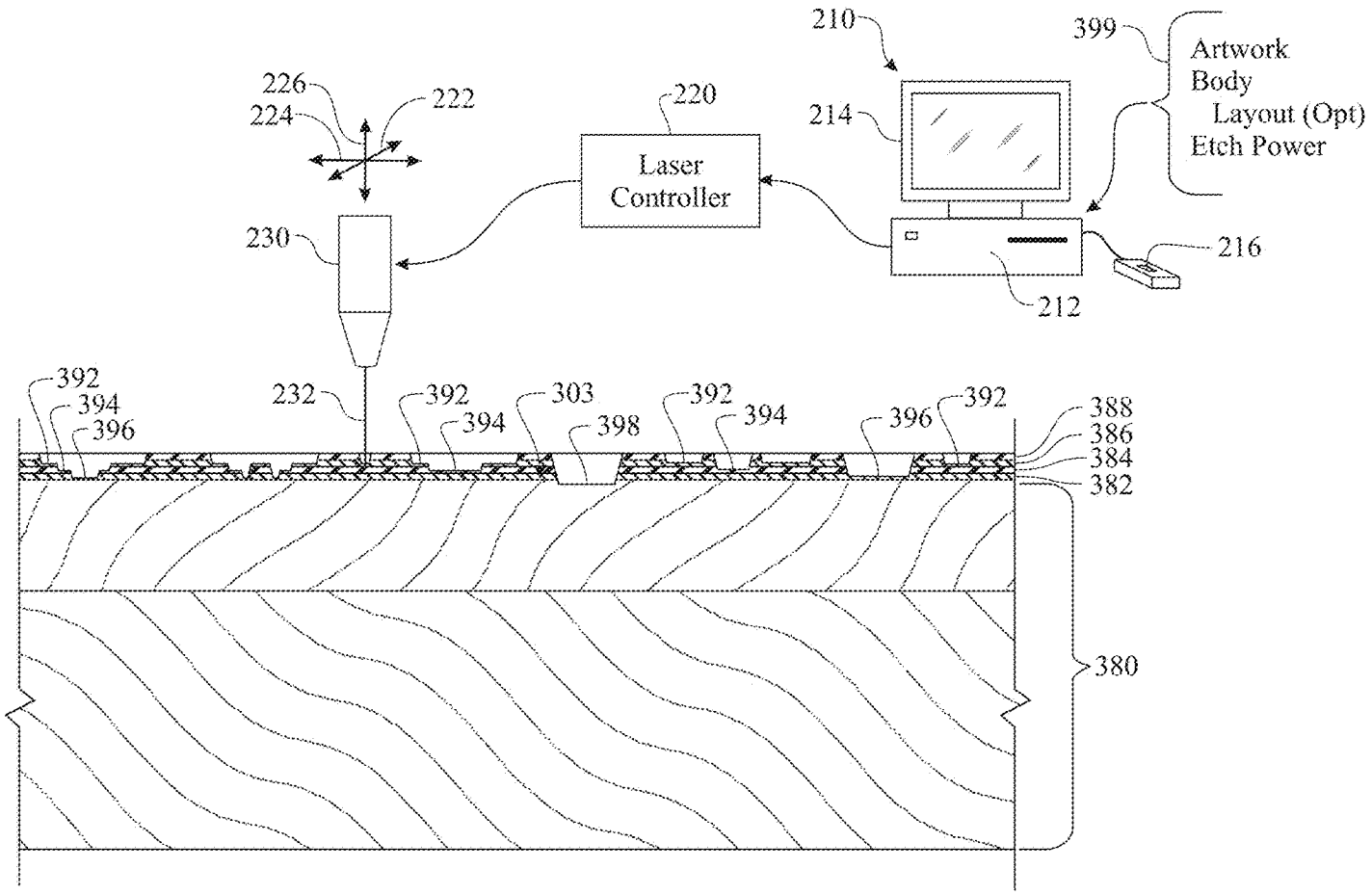
FIG. 12 presents an exemplary cross sectional view of the solid guitar body having a plurality of coating layers applied to an exterior surface, having a laser generated artwork etched through any number of coating layers exposing a contrasting surface therebeneath to create an artwork image having multiple colors.

The process can be enhanced by applying a plurality of layers of coatings 382, 384, 386, 388 to the guitar body top surface 303 of the laser etched guitar 300 as presented in a cross sectioned view illustrated in FIG. 12. Each of the layers of coatings 382, 384, 386, 388 can be of a different material, color, and the like, providing a contrast therebetween. The digital artwork image would be separated into each color, wherein the color is associated with a color of a coating layer of said plurality of coating layers beneath each predetermined number of coating layers. The digital representation of the artwork image 390 would define a number of layers to be etched to expose the layer having the desired color. The laser 230 would be operated at different powers for etching through a different number of layers of coatings 382, 384, 386, 388. The etching can be provided through one group of layers along a single region creating an etched area presenting a single contrast color. In another region, the etched region can be segmented to cut through different layers within a single region creating an etched area presenting multiple contrast colors. This is illustrated in a stair-stepped etch section as shown in FIG. 12. Each adjacent etching within the single region can be either an etching to the same depth, an etching to a depth of an adjacent layer, or an etching to a depth of a distant layer. As the laser beam 232 etches through each layer, the removed material exposes a next layer, thus presenting a different color. When etching through all layers, the laser beam 232 can be programmed to expose the guitar body material 380 or burn the guitar body material 380, thus increasing a contrast between the guitar body material 380 and the guitar body coating nth layer 388. Once the etching process is complete, the etched surface can be protected by applying a clear coat over the surface.

It is understood that the laser etching 390 can be applied to a target section of the stringed instrument, wherein the target section of the stringed instrument is at least one of the guitar body 302, the guitar neck 310, and the headstock 312. The laser etching 390 can be applied to any exposed surface of the target section of the stringed instrument, including a front surface 303, a rear surface (understood by description), and a side surface (understood by description).

It is understood that the laser etching process can alternatively be accomplished by setting a power of the laser at a level that changes the color of the coating material. The change in color of the coating material would create the contrast to original color of the coating material, thus replicating the desired image upon the target section of the stringed instrument.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTION REFERENCES

Ref No. Description

100 training guitar
102 guitar body
104 neck receptacle
110 guitar neck
111 neck mount section
112 headstock
114 fingerboard
116 nut
118 fret
120 fret marker
122 fret number
124 note reference
126 note reference filler
127 note reference depth
128 neck attachment screw
130 tailstock
132 bridge
134 tuning machine
135 tuning peg
136 string
138 pickguard
140 pickup
142 pickup selector switch
144 volume and tone controls
146 output jack connector
150 strap fastener
160 fret slot
162 fret depth
164 fret slot depth
170 fret side marker
200 laser wood removal system
210 laser programming station
212 computer
214 monitor
216 user computer input appliance
219 exemplary entry data
220 laser controller
222 laser lateral movement
224 laser longitudinal movement
226 laser vertical movement
230 laser
232 laser beam
300 laser etched guitar
302 guitar body
303 guitar body top surface
310 guitar neck
312 headstock
314 fingerboard
316 nut
330 tailstock
332 bridge
334 tuning machine
335 tuning peg
336 string
338 pickguard
340 pickup
342 pickup selector switch
344 volume and tone controls
346 output jack connector
350 strap fastener
380 guitar body material
382 guitar body coating first layer
384 guitar body coating second layer
386 guitar body coating third layer
388 guitar body coating nth layer
390 laser etching
392 first laser etched depth
394 second laser etched depth
396 third laser etched depth
398 nth laser etched depth

What is claimed is:

1. A method of adorning at least one of a body, a neck, and a headstock of a stringed instrument, the method comprising steps of:

obtaining a stringed instrument having an outer coating layer applied over at least one of said body, said neck and said headstock;

defining a digital representation of an artwork image for application upon a target section of said stringed instrument, wherein said target section of said stringed instrument is at least one of said body, said neck and said headstock;

programming said digital representation of said artwork image into a computer controlling a laser etching system;

programming a laser etching power into said computer;

locating a laser and said target section of said stringed instrument in registration with one another whereby said laser will replicate said artwork image onto said target section of said stringed instrument at a desired location; and etching said artwork image onto said target section of said stringed instrument at a desired location by using said laser in accordance with said digital representation of said artwork image by laser etching removal of said outer coating layer over said at least one of said body, said neck, and said headstock to create a contrast with a finish of an exposed surface of a layer beneath said outer coating layer of said target section, wherein said contrast creates a visible image replicating said artwork image.

2. A method as recited in claim 1, the method further comprises a step of:

using said laser to change a color of said outer coating layer of said target section in a pattern replicating said artwork image, wherein said change in color creates said contrast.

3. A method as recited in claim 1, the method further comprises a step of:

using said laser to remove said outer coating layer of said target section in a pattern replicating said artwork image to expose a material under said outer coating layer, wherein said material under said outer coating layer is different in color from said outer coating layer and said contrast between said exposed material and said outer coating layer creates a visible image replicating said artwork image.

4. A method as recited in claim 1, the method further comprises steps of:

providing a topographical profile of said target section of said stringed instrument to said computer; and compensating laser settings to accommodate said topographical profile during said etching process.

5. A method as recited in claim 1, the method further comprises a step of:

applying a clear coat layer over said laser etched artwork image.

6. A method as recited in claim 1, wherein said target section is fabricated of a wood, the method further comprises a step of:

etching through all coating layers of said at least one coating layer exposing said wood material.

7. A method as recited in claim 1, wherein said target section is fabricated of a wood, the method further comprises steps of:

etching through all coating layers of said at least one coating layer exposing said wood material; and etching said exposed wood at a level that discolors said wood.

8. A method as recited in claim 1, further comprising a step of applying a filler material into said etched artwork image to enhance said contrast of said visual image.

9. A method as recited in claim 1, further comprising a step of projecting an temporary image of said artwork image upon said target section of said stringed instrument to determine if said laser and target section of said stringed instrument are in proper alignment prior to initiating said etching step.

10. A method as recited in claim 1, wherein said process is applied to one of: a hollow body guitar, a solid body guitar, a hollow body bass guitar, a solid body bass guitar, an acoustic violin, an electric violin, a cello, a banjo, and a mandolin.

11. A method of adorning at least one of a body, a neck, and a headstock of a stringed instrument, the method comprising steps of:

obtaining a stringed instrument having at least one coating layer applied over at least one of said body, said neck and said headstock;

defining a digital representation of an artwork image for application upon a target section of said stringed instrument, wherein said target section of said stringed instrument is at least one of said body, said neck and said headstock;

programming said digital representation of said artwork image into a computer controlling a laser etching system;

programming a laser etching power into said computer;

locating a laser and said target section of said stringed instrument in registration with one another whereby said laser will replicate said artwork image onto said target section of said stringed instrument at a desired location; and etching said artwork image onto said target section of said stringed instrument at a desired location by using a laser to remove a portion of an at least an outer layer of said at least one coating layer from said target section of said stringed instrument in accordance with said digital representation said artwork image, wherein said removed portion of said at least an outer layer exposes a material beneath said removed portion of said at least an outer layer, creating a contrast, wherein said contrast creates a visible image replicating said artwork image.

12. A method as recited in claim 11, the method further comprises steps of:

providing a topographical profile of said target section of said stringed instrument to said computer; and compensating laser settings to accommodate said topographical profile during said etching process.

13. A method as recited in claim 11, the method further comprises a step of:

applying a clear coat layer over said laser etched artwork image.

14. A method as recited in claim 11, wherein said target section is fabricated of a wood, the method further comprises a step of:

etching through all coating layers of said at least one coating layer exposing said wood material.

15. A method as recited in claim 11, wherein said target section is fabricated of a wood, the method further comprises steps of:

etching through all coating layers of said at least one coating layer exposing said wood material; and etching said exposed wood at a level that discolors said wood.

16. A method as recited in claim 11, wherein said target section comprises a plurality of coating layers, the method further comprises steps of:

segmenting said artwork image into different colors;

programming said laser to etch through a predetermined number of coating layers, wherein a coating layer of said plurality of coating layers beneath each predetermined number of coating layers is associated with one color of said different colors of said artwork image;

etching said artwork image into said target section of said stringed instrument by etching through said predetermined number of coating layers of said plurality of coating layers in accordance with said associated color of said different colors of said artwork image.

17. A method as recited in claim 11, further comprising a step of projecting an temporary image of said artwork image upon said target section of said stringed instrument to determine if said laser and target section of said stringed instrument are in proper alignment prior to initiating said etching step.

18. A method as recited in claim 11, wherein said process is applied to one of: a hollow body guitar, a solid body guitar, a hollow body bass guitar, a solid body bass guitar, an acoustic violin, an electric violin, a cello, a banjo, and a mandolin.

* * * * *